US008334503B2

(12) United States Patent
Mcluckey et al.

(10) Patent No.: US 8,334,503 B2
(45) Date of Patent: Dec. 18, 2012

(54) PARALLEL ION PARKING IN ION TRAPS

(75) Inventors: Scott A. Mcluckey, West Lafayette, IN (US); Paul A. Chrisman, Normal, IL (US); Sharon J. Pitteri, Seattle, WA (US)

(73) Assignee: Purdue Research Foundation, West Lafayette, IN (US)

( * ) Notice: Subject to any disclaimer, the term of this patent is extended or adjusted under 35 U.S.C. 154(b) by 515 days.

(21) Appl. No.: 11/920,062

(22) PCT Filed: May 1, 2006 (Under 37 CFR 1.47)

(86) PCT No.: PCT/US2006/016549
§ 371 (c)(1), (2), (4) Date: Jun. 11, 2009

(87) PCT Pub. No.: WO2006/121668
PCT Pub. Date: Nov. 16, 2006

(65) Prior Publication Data

US 2010/0084548 A1 Apr. 8, 2010

Related U.S. Application Data

(60) Provisional application No. 60/679,063, filed on May 9, 2005.

(51) Int. Cl.
*H01J 49/26* (2006.01)

(52) U.S. Cl. ..... 250/283; 250/281; 250/282

(58) Field of Classification Search ..... 250/281, 250/282, 283, 288, 290, 291, 292, 293
See application file for complete search history.

(56) References Cited

U.S. PATENT DOCUMENTS

| | | | | |
|---|---|---|---|---|
| 5,134,286 | A | 7/1992 | Kelley | |
| 5,598,001 | A | 1/1997 | Flory et al. | |
| 6,570,151 | B1 | 5/2003 | Grosshans et al. | |
| 6,674,067 | B2 | 1/2004 | Grosshans et al. | |
| 6,847,037 | B2 | 1/2005 | Umemura | |
| 2002/0003209 | A1 * | 1/2002 | Wood et al. | 250/282 |
| 2004/0173740 | A1 * | 9/2004 | McLuckey et al. | 250/288 |
| 2005/0067565 | A1 * | 3/2005 | Takada et al. | 250/292 |

(Continued)

FOREIGN PATENT DOCUMENTS

WO WO 03/017319 * 2/2003

OTHER PUBLICATIONS

McLuckey et al., "Ion Parking during Ion/Ion reactions in Electrodynamic Ion Traps", ANalytical Chemistry 2002, 74, pp. 336-346.*

(Continued)

*Primary Examiner* — David A Vanore
*Assistant Examiner* — Nicole Ippolito
(74) *Attorney, Agent, or Firm* — Brinks Hofer Gilson & Lione

(57) ABSTRACT

A method of controlling ion parking in an ion trap includes generating a trapping field for trapping cations and anions, and applying a tailored waveform during a period when ion/ion reactions occur to park first generation product ions with m/z values that differ from those of a cation and an anion in selected m/z regions. In particular, the tailored waveform inhibits simultaneously the reactions of ions of disparate m/z ratios.

18 Claims, 3 Drawing Sheets

U.S. PATENT DOCUMENTS

2005/0199804 A1* 9/2005 Hunt et al. ..... 250/290

OTHER PUBLICATIONS

McLuckey Scott A. et al.; "Ion Parking During Ion/Ion Reactions in Electrodynamic Ion Traps," Analytical Chemistry, American Chemical Society, Columbus, US; vol. 74, No. 2, Jan. 2002; pp. 336-346.

Reid, Gavin E. et al.; "Performance of a Quadrupole Ion Trap Mass Spectrometer Adapted for Ion/Ion Reaction Studies," International Journal of Mass Spectrometry; Elsevier Science Publishers; Amsterdam, NL; vol. 222; No. 1-3; Jan. 2003; pp. 243-258.

Chrisman, Paul A. et al.; "Parallel Ion Parking: Improving Conversion of Parents to First-Generation Products in Electron Transfer Dissociation," Analytical Chemistry; May 15, 2005; vol. 77, No. 10; pp. 3411-3414.

International Search Report for related application No. PCT/US2006/016549, dated Aug. 16, 2007.

Written Opinion of the International Searching Authority for related application No. PCT/US2006/016549, dated Aug. 16, 2007.

* cited by examiner

PARALLEL ION PARKING IN ION TRAPS

RELATED APPLICATION

This application claims the benefit of U.S. Provisional Application No. 60/679,063, filed May 9, 2005, the entire contents of which are incorporated herein by reference.

GOVERNMENT INTERESTS

This invention was made with U.S. Government support under Grant No. GM45372 awarded by the National Institutes of Health. The U.S. Government has certain rights in this invention.

BACKGROUND

Electron capture dissociation (ECD)[1,2] and electron transfer dissociation (ETD)[3-5] are two analytically useful techniques for obtaining polypeptide amino acid sequence information. For ECD, the electron capture cross section is predicted to be dependent on the square of the cation charge.[6] A similar rate dependence upon charge has been observed for ion/ion reactions.[7] A complication associated with both ECD and ETD, as currently practiced, is the possibility for sequential electron capture or electron transfer reactions. For example, first generation products can undergo sequential reactions that lead to higher generation products to the point where, in the extreme case, all cations are neutralized. Such sequential reactions are problematic because they can decrease the overall signal level of informative fragment ions and create spectral complication due to the appearance of internal fragment ions. According to some researchers[8], the maximum obtainable fragmentation efficiency in ECD is 43.75% for doubly charged ions, and is not likely to exceed 50% for higher charge states while other researchers[6] have reported that ECD efficiency is usually 30%. Furthermore, it has been suggested that secondary internal product ions are minimal when a significant amount of the precursor ion remains unreacted and the maximum efficiency is reached when two thirds of the precursor ions have reacted.[6,9] Ideally, however, it is desirable to convert all precursor ions into structurally informative products. To this end, it is desirable to minimize contributions from second and higher generation sequential reactions while maximizing the fraction of parent ions that undergo reaction.

It has been shown that rates of selected ion/ion reactions in a quadrupole ion trap can be inhibited by applying a single frequency dipolar resonance excitation voltage to the endcaps, in a process termed "ion parking".[10] This method is effective for parking ions of a selected m/z ratio, as the resonant excitation increases the velocities of the selected ions, greatly reducing their reaction rates and also reducing the spatial overlap of oppositely charged ions. Alternatively, some have employed the use of a dipolar DC voltage across the endcaps to control charge neutralization in a quadrupole ion trap mass spectrometer.[11,12] The method is effective at parking ions above a selected m/z ratio, by physically separating the cation and anion clouds on the basis of pseudopotential well-depth, which is related to m/z ratio under a fixed set of ion storage conditions.

SUMMARY

The present invention is directed to a method of controlling ion parking in an ion trap by generating a trapping field for trapping cations and anions, and applying a tailored waveform during a period when ion/ion reactions occur to park first generation product ions with m/z values that differ from those of a cation and an anion in selected m/z regions. In particular, the tailored waveform inhibits simultaneously the reactions of ions of disparate m/z ratios.

The tailored waveform can be a filtered noise field that resonantly accelerates ions over a broad m/z range. In such implementations, the filtered noise field accelerates all ions other than the cation and anion in the selected m/z regions. Further, the filtered noise field allows a reaction to occur between the cation and anion but inhibits further reaction by any product that fall within the range of Ions that undergo acceleration.

Further features and advantages of this invention will be apparent from the following description, and from the claims.

DETAILED DESCRIPTION

Electron transfer dissociation (ETD) in a tandem mass spectrometer is an analytically useful ion/ion reaction technique for deriving polypeptide sequence information, but its utility can be limited by sequential reactions of the products. Sequential reactions lead to neutralization of some products, as well as to signals from products derived from multiple cleavages that can be difficult to interpret.

In accordance with an embodiment of the invention, a method and system of ion parking to inhibit sequential ETD fragmentation in a quadrupole ion trap is provided. The method is based on parking all ions other than those in selected regions of m/z. Since this method is intended to inhibit simultaneously the reactions of ions of disparate m/z ratios, it is referred to as "parallel ion parking". The concept involves the continuous application of a tailored waveform during the ion/ion reaction period that does not affect the reagent anion and analyte cation but leads to the parking of all first generation product ions with m/z values that differ significantly from those of the reactants.

In a particular implementation, a system and method of inhibiting sequential ETD fragmentation in a quadrupole ion trap is provided for the reaction of a triply protonated peptide with nitrobenzene anions. A tailored waveform (in this case, a filtered-noise field (FNF)) is applied during the ion/ion reaction time to accelerate simultaneously first generation product Ions, and thereby inhibit their further reaction. This results in approximately a 50% gain in the relative yield of first generation products, and allows for the conversion of more than 90% of the original parent ions into first generation products. Gains are expected to be even larger when higher charge state cations are used, as the rates of sequential reaction become closer to the initial reaction rate.

Figure 1A:
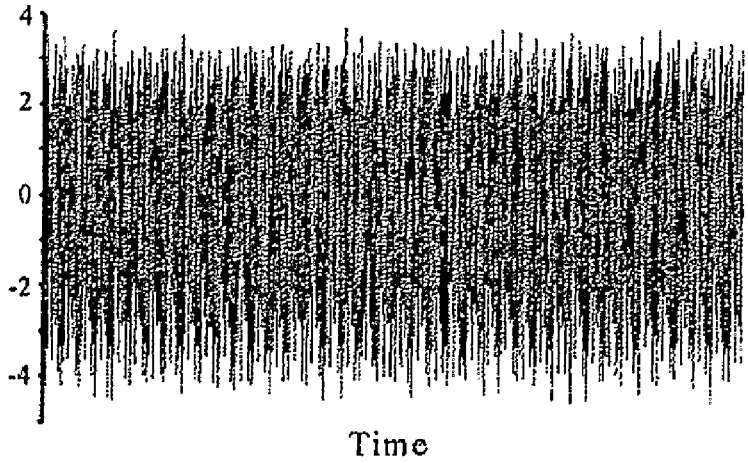
FIG. 1A shows a FNF waveform in the time domain in accordance with an embodiment of the invention.
Figure 1B:
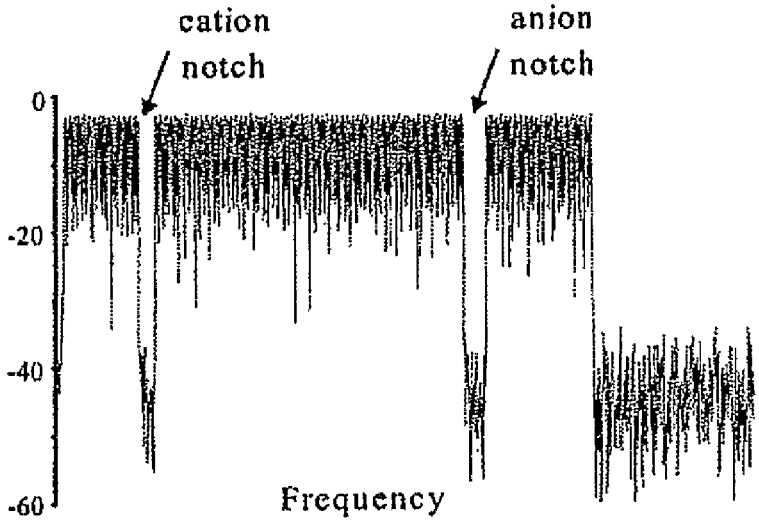
FIG. 1B shows the FNF waveform in the frequency domain in accordance with the invention.

Specifically, a filtered noise field (FNF)[13,14] waveform is employed to resonantly accelerate ions over a broad m/z range. If the FNF waveform is chosen so that it accelerates all ions other than the desired cation and anion, then it allows one reaction to occur, but inhibit further reaction by any products that fall within the range of ions that undergo acceleration. An example of the time and frequency domain of such a waveform is shown in FIGS. 1A and 1B, respectively, with the indicated frequencies excluded so that the reactant ions are not excited. The indicated waveform includes a series of frequencies spaced by 1 kHz, each with an amplitude of a few hundred millivolts. Gaps in frequency are selected to coincide with the z-dimension frequencies of motion associated with the reactant ions. The situation depicted in FIG. 1 is that of a relatively high m/z cation in reaction with a relatively low m/z anion. For a given set of ion trap storage conditions, the cation freguency is lower than the anion frequency. Under typical conditions (e.g., ion trap radius of 1 cm, ion trapping frequency of 1 MHz, ion trapping amplitude of a few hundred volts, the cation frequency is usually in the low tens of kHz while the anion frequency is in the high tens of kHz to low hundreds of kHz.

The following example is described below for purposes of illustrating the invention and is not to be construed as a limitation of the invention.

EXAMPLE

In a particular experiment, the tailored waveform ETD was applied to reactions of a multiply protonated peptide. Methanol and glacial acetic acid were Purchased from Mallinckrodt (Phillipsburg, N.J.). Angiotensin I, RKRARKE, and nitrobenzene were obtained from Sigma (St. Louis, Mo.). Neurotensin was obtained from Bachem (King of Prussia, Pa.). All experiments were performed on a Hitachi (San Jose, Calif.) M-8000 3-DQ ion trap mass spectrometer adapted for ion/ion reactions. Details of the ion trap mass spectrometer are described in Reid, G. E.; Wells, J. M.; Badman, E. R.; McLuckey, S. A. *Int. J. Mass Spectrom.* 2003, 222, 243-258[15], the entire contents of which are incorporated herein by reference. In a typical experiment peptide cations were formed using nano-electrospray[5] and injected into the ion trap for −1 s. Nitrobenzene anions were formed using atmospheric sampling glow discharge ionization (ASGDI) and introduced via a hole in the ring electrode (~50 ms).[16] Ion/ion reactions were allowed to take place for a given period (~300 ms) during which an FNF waveform generated by the instrument software was used to inhibit the further reaction of product ions. Mass analysis was performed by resonance ejection. Spectra shown here are an average of ~250 scans.

Figure 2:
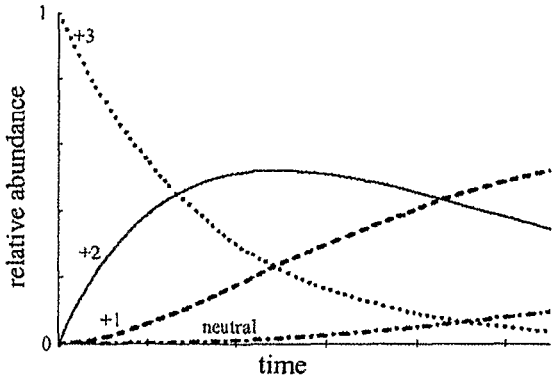
FIG. 2 shows the results of a simulation for reactions between a triply charged cation and a singly charged anion assuming a reaction rate dependence on chard squared and no fragmentation.

The charge squared dependence of ion/ion reactions has implications for the time evolution of different generation products derived from a given starting population. In the case of ion/ion reactions that lead to reduction of charge without any dissociation, the relative amounts of the different products are straightforward to predict. Assuming that reaction rates scale with the square of the charge of the cation (singly charged anion case) and that there Is a large excess of anions, pseudo-first order kinetics can be assumed[9] and a plot such as that of FIG. 2 applies. In this case, a starting population of +3 ions is converted to +2, +1, and neutral products. The maximum relative quantity of +2 ions that can be formed is about 50% of the initial ion population, and this will occur when the quantity of unreacted ions (the +3 ions) Is approximately equal to that of the ions that have reacted twice (the +1 ions). Ion parking with a single frequency has been demonstrated as a means of converting nearly all of the initial Ion population into first generation products with minimal formation of higher generation products in non-dissociative reactions.[10]

In a case like electron transfer, where each reaction step can lead to fragmentation along with the charge reduction, the picture is more complex. A +3 ion can react and fragment to form a +2 product ion and a neutral product molecule, or it can react and fragment to form two +1 product ions, and the two cases will result in different subsequent reaction rates for the first generation product. This complicates quantitative prediction of the point at which the maximum amount of first generation products will be present and what the maximum amount will be. Nevertheless, as long as the rates of subsequent reactions are appreciable, a maximum in the amount of first generation products that can be formed cannot approach 100%. A means for inhibiting the reaction rates of all first generation product ions simultaneously allows for the formation of first generation products to approach 100%.

FIG. 3 demonstrates the use of tailored waveforms for this purpose. In FIG. 3*a* the reaction of angiotensin I $(M+3H)^{3+}$ ions with nitrobenzene anions is shown. Reaction occurs through a mixture of proton transfer without dissociation, and electron transfer both with and without dissociation. Reaction without dissociation leads to the peptide ions with reduced charge states. Dissociation leads to the variety of c- and z-type sequence ions, as well as a variety of small molecule losses. FIG. 3*b* shows the same reaction with an FNF applied to resonantly excite all ions between m/z 480 and m/z 2000, thereby reducing their ion/ion reaction rates. FIGS. 3*c* and 3*d* show the data of FIGS. 3*a* and 3*b*, respectively, with vertically expanded scales.

Figure 3A:
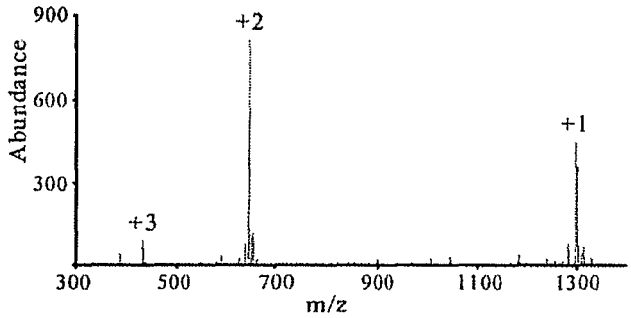
FIG. 3A shows reaction spectra of triply protonated angiotensin I with nitrobenzene anions with no ion parking.
Figure 3B:
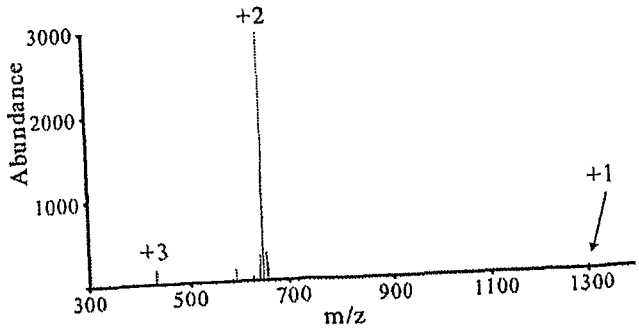
FIG. 3B shows reaction spectra of triply protonated angiotensin I with nitrobenzene anions with ion parking for ion frequencies that correspond to m/z 480-2000, 0.1 V.
Figure 3C:
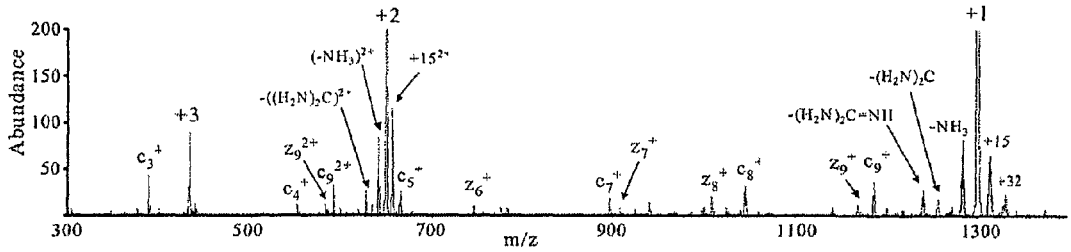
FIG. 3C shows the y-axis expanded view of FIG. 3A.
Figure 3D:
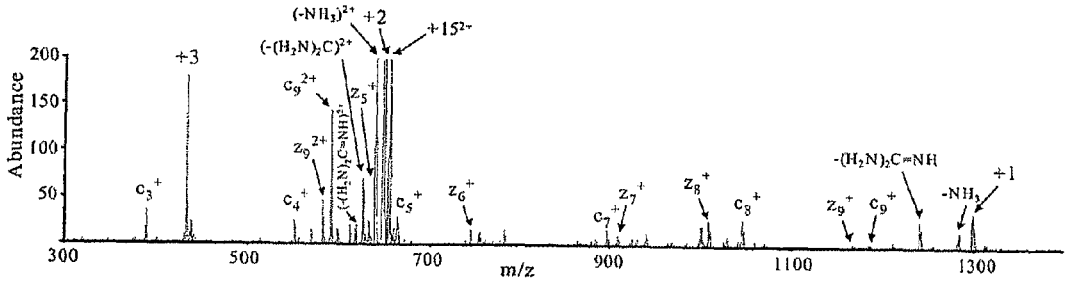
FIG. 3D shows the y-axis expanded view of FIG. 3B.

Adjustment of the waveform amplitude is performed so that reaction rates are diminished as much as possible without leading to collision induced dissociation or ion ejection from the trap. In principle, the m/z range between the +3 angiotensin I ions and the nitrobenzene anions could also have been included in the FNF waveform, but as few ions are formed in this region during the reaction, frequencies associated with the m/z range between the cation and anions were not included in the FNF used here. A number of changes are apparent when the results of FIGS. 3*a* and 3*c* are compared with those of FIGS. 3*b* and 3*d*, for instance, the difference in the relative abundances of the +1 and +2 peptide ions, as +2 is greatly increased. The relative abundances of fragment ions that are observed as +2 ions are increased in FIGS. 3*b* and 3*d*, and the +1 charge states of those same ions are less abundant. This is notable for the $c_9$ and $z_9$ sequence ions, as well as for the ions that arise from loss of $NH_3$ and loss of $(H_2N)_2C$ from the peptide. This indicates that, as first generation products, these ions are formed mostly as +2 species, and the +1 ions observed in FIG. 3*c* are largely the result of a subsequent charge reduction reaction. Interestingly, the loss of 59 Da from the +1 ion, believed to be the loss of $(H_2N)_2C{=}NH$ from the arginine side chain, is not observed to decrease when the FNF is applied, which suggests that it is formed largely as a first generation product. The $c_3^+$-$c_8^+$ and $z_5^+$-$z_8^+$ sequence ions show little change in abundance when the waveform is applied, indicating that they are also formed largely as first generation products, because of the absence of their corresponding +2 ions from spectra obtained in the absence of ion parking.

The gain in first generation products can be estimated by summing the abundances of the first generation products, and dividing that sum by the sum of all ion abundances. This can then give a percentage of observed ions that have reacted once. Results of doing so for several peptides are reported in Table 1, both with and without the parallel parking.

TABLE 1

SUMMARY OF % OBSERVED IONS WITH AND WITHOUT PARKING

| | No Parking | | | With Parking | | |
|---|---|---|---|---|---|---|
| | % Remaining $[M + 3H]^{3+}$ | % First Generation Products | % Second Generation Products | % Remaining $[M + 3H]^{3+}$ | % First Generation Products | % Second Generation Products |
| Angiotensin I | 4.2 | 63.6 | 32.2 | 4.0 | 94.6 | 1.4 |
| RKRARKE | 2.0 | 65.3 | 32.7 | 1.5 | 92.8 | 5.7 |
| Neurotensin | 5.1 | 68.2 | 26.7 | 3.7 | 91.2 | 5.1 |

As can be seen, there is an approximately 50% gain in first generation products when the waveform is applied. This estimate is a lower limit because the method for determining the percentage of first generation products does not account for those sequential reactions that lead to complete neutralization. Since such products are expected to be formed much more in the absence of the waveform, the percentage of first generation products is overestimated, on a relative basis, from the data in the absence of ion parking. Use of the waveform allows more than 90% of the total signal to be accumulated in first generation products, as compared with roughly 60% in the absence of the waveform. Gains in the conversion of precursor ions to first generation products ion via the use of this technique can be larger when it is applied to more highly charged reactant ions, as the difference in rate between the first reaction and subsequent reactions decreases, resulting in a lower maximum for first generation products. In addition, for larger systems the range of internal Ions which could potentially be formed by sequential reactions Increases greatly.

In accordance with various embodiments of the invention, the parallel ion parking technique is not restricted to ETD or ion/ion reactions in general. It can find utility with any ion trap activation method in which the activating agents (e.g., ions, electrons, photons, metastable atoms, fast atoms) and ion populations are present in narrowly defined regions of space. Spatial overlap of the ion population . and the activating agents provides for activation to occur. A degree of selectivity for products derived from a first generation fragmentation process is provided by parallel ion parking. Therefore, improved conversion of parent ions to first generation product ions can also be anticipated for techniques such as infrared multi-photon dissociation (IRMPD),[17,18] or any other form of beam-based activation method. The linear trap may be a linear ion trap. In some implementations, a nano-electrospray is employed to form analyte ions that are injected into the ion trap. Further, any form of ionization capable of forming ions of opposite polarity to the analyte Ions may be employed. Reagent ions may be introduced into the ion trap from an external ion source. The product ions may be subjected to mass analysis after transfer from the ion trap to another form of mass analyzer. Ion/ion reactions may occur for a period in the range between about 30 and 300 ms.

REFERENCES

The following references are incorporated herein by reference in their entirety:

(1) Zubarev, R. A.; Kelleher, N. L.; McLafferty, F. W. *J. Am. Chem. Soc.* 1998, 120, 3265-3266

(2) Zubarev, R. A. *Mass Spectrom. Rev.* 2003, 22, 57-77

(3) Coon, J. J.; Syka, J. E. P.; Schwartz, J. C.; Shabanowitz, J.; Hunt, d. F. *Int J. Mass Spectrum.* 2004, 236, 33-42

(4) Syka, J. E. P.; Coon, J. J.; Schroeder, M. J.; Shabanowitz, J.; Hunt, D. F. *Proc. Natl. Acad. Sci. USA* 2004, 101, 9528-9533

(5) Pitted, S. J.; Chrisman, P. A.; Hogan, J. M.; McLuckey, S. A. *Anal. Chem.* 2005, 77, 1831-1839.

(6) Zubarev, R. A.; Horn, D. M.; Fridriksson, E. K.; Kelleher, N. L.; Kruger, N A; Lewis, M A.; Carpenter, B. K.; McLafferty, F. W. *Anal. Chem.* 2000, 72, 563-573

(7) Stephenson, J. L. Jr.; McLuckey, S. A. *J. Am. Chem. Soc.* 1996, 118, 7390-7397

(8) Gorshkov, M. C.; Masselon, C D.; Nikolaev, E. N.; Udseth, H. R.; Pasa-Tolic, L.; Smith, R. D. *Int. J. Mass Spectrum.* 2004, 234, 131-136

(9) Zubarev, R. A.; Haselmann, K F.; Budnik, B.; Kjeldsen, F.; Jensen, F. *Eur. J. Mass Spectrom.* 2002, 8, 337-349

(10) McLuckey, S. A.; Reid, G. E.; Wells, J. M. *Anal. Chem.* 2002, 74, 336-346.

(11) Grosshans, P. B.; Ostrander, C. M.; Walla, C. A. *Methods and Apparatus to Control Charge Neutralization Reactions in Ion Traps*, U.S. Pat. No. 6,674,067B2, Jan. 6, 2004.

(12) Grosshans, P. B.; Ostrander, C. M.; Walla, C. A. *Methods and Apparatus to Control Charge Neutralization Reactions in Ion Traps*, U.S. Pat. No. 6,570151B1, May 27, 2003.

(13) Kelley, P. E. *Mass Spectrometry Method using Notch Filter*, U.S. Pat. No. 5,134,286, Jul. 28, 1992.

(14) Goeringer, D. E.; Asano, K. G.; McLuckey, S. A.; Hoekman, D.; Stiller, S. E. *Anal. Chem.* 1994, 66, 313-318.

(15) Reid, G. E.; Wells, J. M.; Badman, E. R.; McLuckey, S. A. *Int. J. Mass Spectrom.* 2003, 222, 243-258.

(16) Hogan, J. M.; Pitteri, S. J.; Chrisman, PA.; McLuckey, S. A. *J. Proteome Res.* 2005, 4, 1831-1839.

(17) Colorado, A.; Shen, J. X.; Vartanian, V. H.; Brodbelt, J. *Anal. Chem.* 1996, 68, 4033-4043.

(18) Stephenson, J. L.; Jr.; Booth, M. M.; Shalosky, J. A.; Eyler, J. R.; Yost, R. A. *J. Am. Soc. Mass Spectrom.* 1994, 5, 886-893.

What is claimed is:

1. A method of controlling ion parking in an ion trap comprising:

generating a trapping field for trapping cations and anions; and applying a voltage waveform having a plurality of frequency components and amplitudes selected such that ions with a range of m/z values that differ from an m/z value of a selected cation and an m/z value of a selected anion are parked, wherein a gap in the spacing of the plurality of frequency components coincides with at least one of a z-dimension frequency of motion of the selected cation or of the selected anion.

2. The method of claim 1 wherein the voltage waveform is a filtered noise field that resonantly accelerates ions over a selected range of m/z values.

3. The method of claim 2 wherein the filtered noise field allows a reaction to occur between the selected cation and the selected anion but inhibits further reaction by ion products that fall within the selected range of ions that undergo resonant acceleration.

4. The method of claim 1 wherein applying the voltage waveform provides for a conversion of more than about 90% of parent ions into first generation reaction products.

5. The method of claim 1 wherein the ion parking inhibits electron transfer dissociation fragmentation.

6. The method of claim 1 wherein the ion parking inhibits proton transfer reactions.

7. The method of claim 1 wherein the ion parking inhibits ion/ion reactions of any mechanism.

8. A system for controlling ion parking comprising:

an ion trap;

applying a first voltage to the ion trap to generate a trap for a cation and an anion; and, applying a second voltage waveform having a plurality of frequency components and amplitudes, the second voltage waveform accelerating reaction products having m/z ratios differing from those of the cation and the anion, over a selected range of m/z ratios of the reaction products, so that the ions in the selected range of m/z ratios are parked, wherein a gap in the spacing of the plurality of frequency components coincides with at least one of a z-dimension frequency of motion of the selected cation or of the selected anion.

9. The system of claim 8 wherein the ion trap is selected from the group comprising a quadrupole ion trap and a linear ion trap.

10. The system of claim 9 further comprising a nano-electrospray for forming analyte ions.

11. The system of claim 10 wherein the analyte ions are injected into the ion trap.

12. The system of claim 10 further comprising an ion source capable of forming reagent ions of opposite polarity to the analyte ions.

13. The system of claim 12 wherein the ion source is an external ion source.

14. The system of claim 9, wherein the second voltage waveform is a filtered noise field.

15. The system of claim 9, wherein a plurality of signals of the second voltage waveform are spaced at 1 kHz intervals.

16. The system of claim 8 wherein ion/ion reactions occur for a period in the range between about 30 and 300 ms.

17. The system of claim 8 wherein product ions are subjected to mass analysis after transfer from the ion trap to another form of mass analyzer.

18. A method of controlling ion parking in an ion trap comprising:

generating a trapping field for trapping cations and anions; and applying a voltage waveform during a period, the voltage waveform having a plurality of frequency components and amplitudes selected such that, when ion/ion reactions occur, first generation product ions with m/z values that differ from those of a cation and an anion in selected regions of m/z are simultaneously parked, wherein a gap in the spacing of the plurality of frequency components coincides with at least one of a z-dimension frequency of motion of the selected cation or of the selected anion.

* * * * *